US006585116B1

(12) United States Patent
Doelle et al.

(10) Patent No.: US 6,585,116 B1
(45) Date of Patent: Jul. 1, 2003

(54) SCREENING APPARATUS FOR FIBER SUSPENSION

(75) Inventors: Klaus Doelle, Menasha, WI (US); Kurt W. Lorenz, Appleton, WI (US); David W. Hostetter, Marblehead, MA (US)

(73) Assignee: Voith Sulzer Paper Technology North America, Inc., Appleton, WI (US)

( * ) Notice: Subject to any disclaimer, the term of this patent is extended or adjusted under 35 U.S.C. 154(b) by 0 days.

(21) Appl. No.: 09/510,064

(22) Filed: Feb. 22, 2000

(51) Int. Cl.[7] ..... B07B 1/20
(52) U.S. Cl. ..... 209/305; 209/283; 209/306
(58) Field of Search ..... 209/273, 281, 209/283, 300, 305, 306, 3.1, 32; 73/7, 86

(56) References Cited

U.S. PATENT DOCUMENTS

| | | | | |
|---|---|---|---|---|
| 3,725,666 A | * | 4/1973 | Berthold | 250/219 |
| 4,427,552 A | * | 1/1984 | Lieberherr et al. | 210/741 |
| 4,479,872 A | * | 10/1984 | Wikdahl | 209/258 |
| 5,326,470 A | * | 7/1994 | Shaw | 210/232 |
| 5,435,444 A | | 7/1995 | Satomi | |
| 5,712,559 A | * | 1/1998 | Moore et al. | 324/71.1 |
| 5,968,357 A | * | 10/1999 | Doelle et al. | 210/485 |
| 5,996,807 A | * | 12/1999 | Rumpf et al. | 209/401 |
| 6,165,370 A | * | 12/2000 | Heissenberger | 210/741 |

FOREIGN PATENT DOCUMENTS

DE 197 02 044 C1 4/1998

OTHER PUBLICATIONS

Derwent Abstract 1979–73276B: Ogarkov, SU (Apr. 28, 1977).*
Derwent Abstract 1984–187705: Evstratov, SU (Sep. 3, 1982).*
Derwent Pub. # 1982–J8985E (Abstract of DE 3143779 A, Pub. Date: Jul. 8, 1982; Inventor: Holm, A).*
Derwent Pub. 190 1976–24720X (Abstract of DE 2443548 A, Pub. Date: Mar. 25, 1976; Inventor: Lesk, M).*

* cited by examiner

*Primary Examiner*—Donald P. Walsh
*Assistant Examiner*—Joseph Rodriguez
(74) *Attorney, Agent, or Firm*—Taylor & Aust, P.C.

(57) ABSTRACT

A screening apparatus is used for screening acceptable and rejectable material from a pressurized fiber suspension. The screening apparatus includes a housing, a rotor, a screen basket and at least one sensor. The screen basket is positioned generally concentrically around the rotor, and includes at least one screen element. Each sensor is positioned in association with the screen basket. Each sensor is configured for sensing a wear parameter relating to a wear state of the screen element.

18 Claims, 2 Drawing Sheets

SCREENING APPARATUS FOR FIBER SUSPENSION

BACKGROUND OF THE INVENTION

1. Field of the Invention

The present invention relates to a screening apparatus used to screen acceptable and rejectable material from a fiber suspension, and, more particularly, relates to such a screening apparatus including a screen basket concentrically positioned relative to a rotor.

2. Description of the Related Art

In the paper-making process, a screening apparatus is typically used to separate foreign matter from a fiber suspension. A typical screening apparatus may include a housing within which a screen basket is mounted around a concentrically positioned rotor assembly. The screen basket may be fabricated from a relatively thin metal plate material although bar or wire materials are also often used and when mounted in a screening apparatus provide a barrier between a screening chamber and an accept chamber. The fiber suspension is transported into the screening chamber by way of a feed inlet. The fiber suspension is introduced to either the inner or outer portion of the screen basket, depending upon the particular type of screening apparatus being used. Material which does not pass through the screen basket flows to an end of the screening chamber away from the feed inlet and is removed through a reject outlet.

One known type of screen basket has circular shaped openings sized to reject unwanted solids and may have support rings located along the length of the basket to provide additional mechanical support. Another type of screen basket has slots having lengths much greater than their widths for separating other types of materials and may have support rings located along the length of the screen basket to provide additional mechanical support. Yet another type of screen basket includes longitudinally extending wires which are attached at each end thereof to respective annular retaining rings. The retaining rings are used to mount the screen basket within the screening apparatus. The retaining rings are bolted to a stationary member to prevent the screen basket from rotating in response to the torsional forces generated by the rotating hydrofoils or drum. Such a mounting arrangement generally places the screen basket in an axially compressive loading condition.

The rotor assembly generally includes hydrofoils or a contoured drum mounted on a rotating shaft in close proximity to the screen basket to sweep past the openings of the screen basket. The hydrofoils or contoured drum may be positioned to sweep over the inner or outer surface of the screen basket. The rotating hydrofoils or contoured drum generate hydrodynamic pulses in the radial direction with enough force and frequency to continuously remove any fiber plugs that occur in the screen basket openings. The localized flows caused by the hydrodynamic pulses are generally in a direction opposite to the flow of the fluid pulp provided to the screen basket under pressure.

As the fiber suspension impacts and passes through the screen basket, the screen basket becomes worn over time and must be replaced. Typically, the quality of the accept material which is transported from the accept outlet of the screening apparatus may be periodically monitored to detect if the quality thereof is degrading. A degradation in quality may be correlated to the wear of the screen basket.

What is needed in the art is a method of more directly, accurately and timely determining a wear state of a screen basket within a screening apparatus.

SUMMARY OF THE INVENTION

The present invention provides a screening apparatus including a sensor which senses a wear parameter which may be directly related to a wear state of a screen basket within the screening apparatus.

The invention comprises, in one form thereof, a screening apparatus for screening acceptable and rejectable material from a pressurized fiber suspension. The screening apparatus includes a housing, a rotor, a screen basket and at least one sensor. The screen basket is positioned generally concentrically around the rotor, and includes at least one screen element. Each sensor is positioned in association with the screen basket. Each sensor is configured for sensing a wear parameter relating to a wear state of the screen element.

An advantage of the present invention is that the wear state of the screen basket may be directly determined through the sensed wear parameter.

Another advantage is that the wear state of the screen basket may be directly sensed using different types of sensors.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Figure 1:
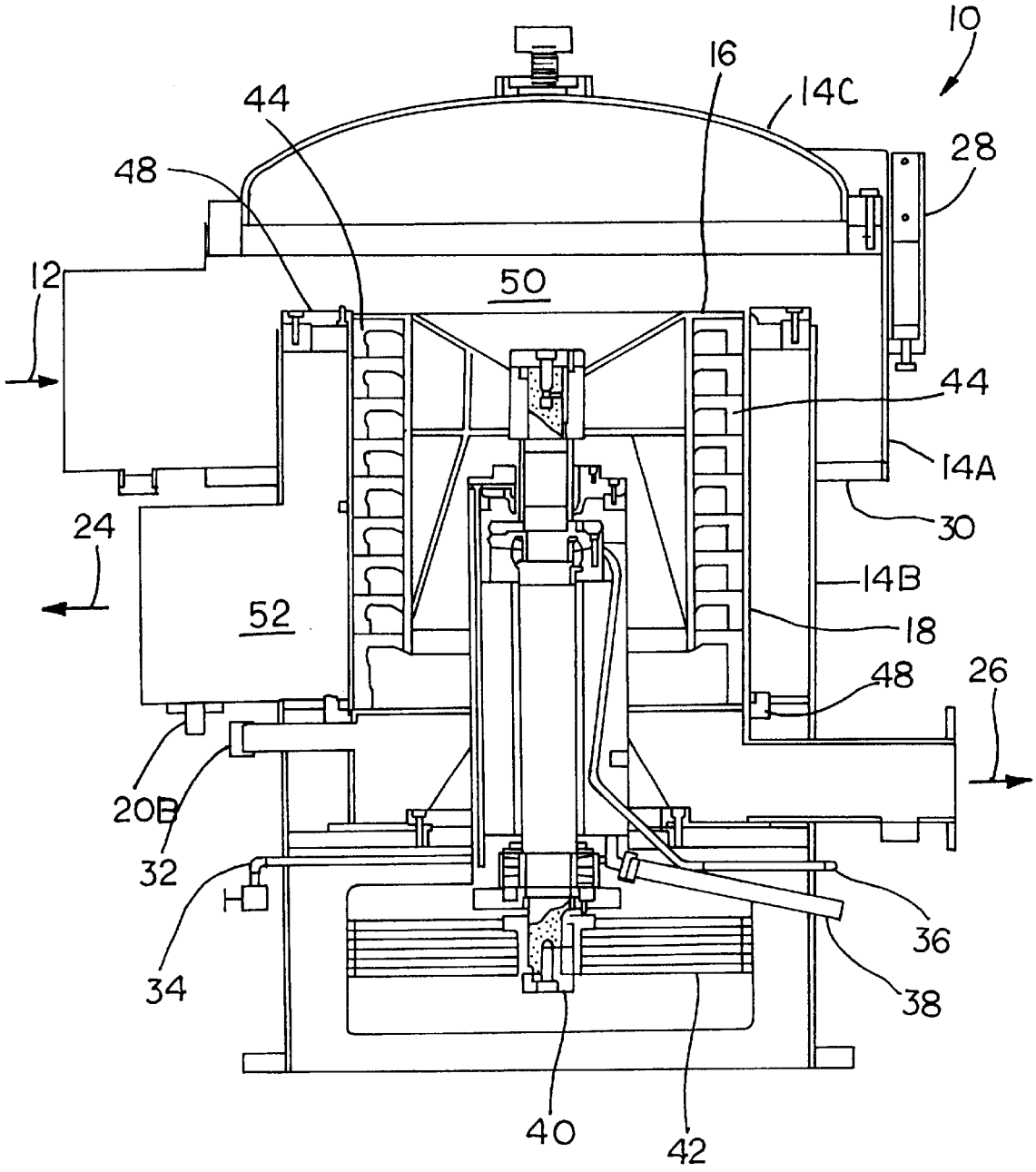
FIG. 1 is a schematic, side view of an embodiment of a screening apparatus of the present invention.

Corresponding reference characters indicate corresponding parts throughout the several views. The exemplifications set out herein illustrates one preferred embodiment of the invention, in one form, and such exemplifications are not to be construed as limiting the scope of the invention in any manner.

DETAILED DESCRIPTION OF THE INVENTION

Referring now to the drawings, and more particularly to FIG. 1, there is shown an embodiment of a screening apparatus 10 of the present invention for screening acceptable and rejectable material from a pressurized fiber suspension 12. Screening apparatus 10 generally includes a housing 14 (designated 14A–14C), rotor 16, screen basket 18, one or more sensors 20, inlet 22, accepts outlet 24 and rejects outlet 26.

Housing 14 includes first housing part 14A, second housing part 14B and third housing part 14C which are attached together with each other. Housing part 14C is in the form of a cover which is attached with housing part 14A via cover hinge 28. Housing part 14A is attached with housing part 14B via intermediate member 30. Housing part 14A defines inlet 22; and housing part 14B defines accepts outlet 24. Rejects outlet 26 extends through housing part 14B. Additional structure of screening apparatus 10 which extends through housing part 14B includes a dilution water inlet 32, seal water line 34, vibration analyzer rod 36 and seal water drain 38.

Rotor 16 is rotatably carried within housing 14. More particularly, rotor 16 is mounted on a shaft 40, which in turn is indirectly carried by housing 14. A driven sheave 42 positioned on an end of shaft 40 is driven by a drive source (not shown) for rotatably driving rotor 16. In the embodiment shown, rotor 16 includes a plurality of axially stacked and radially spaced foils 44 which assist in the screening process using screen basket 18 and cleaning of screen basket 18.

Figure 2:
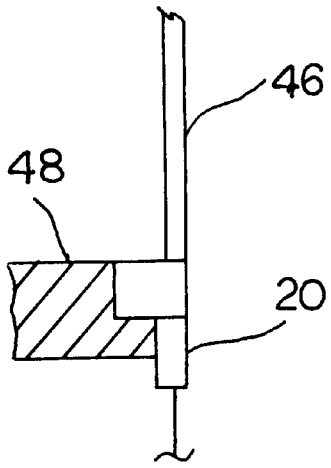
FIG. 2 is an enlarged, fragmentary view of a portion of the screen basket shown in FIG. 1.
Figure 3:
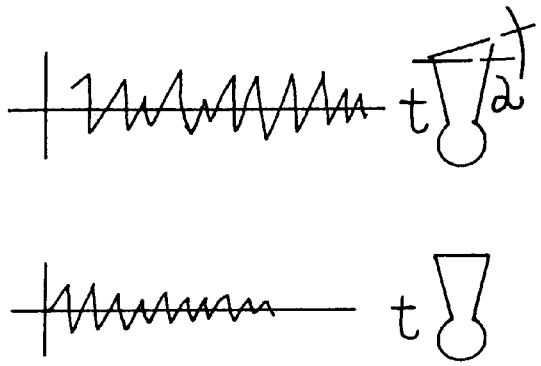
FIG. 3 is a graphical illustration of an output signal associated with wear of the screen basket.

Screen basket 18 is positioned generally concentrically around and closely adjacent to rotor 16. Screen basket 18 includes at least one screen element 46 having or defining a plurality of openings for screening the acceptable material from the rejectable material within fiber suspension 12. In the embodiment shown, screen basket 18 includes a plurality of screen elements 46 in the form of wires which are circumferentially spaced around screen basket 18 with a predetermined distance therebetween for effectively screening fiber suspension 12 (FIGS. 1–3). Wires 46 are attached at each end thereof with a respective pair of annular-shaped retaining rings 48 which are carried by housing part 14B. The space axially above rotor 16 and screen basket 18 defines a screening chamber 50, while the space between screen basket 18 and housing part 14B defines an accept chamber 52.

During use, a fiber suspension to be screened enters inlet 22 under pressure and is urged in a radially outward direction by rotor 16 against screen basket 18. Foils 44 cause pressure pulsations within the fiber suspension adjacent screen basket 18, which in turn causes accepts to flow into accepts chamber 52 while at the same time maintaining the spaces between wires 46 in an open state as a result of the pressure pulsations. Rejects are transported to rejects outlet 26 and then from screening apparatus 10. As wires 46 within screen basket 18 become wore over time, the quality of the accepts which is transported from accepts outlet 24 degrades.

According to an aspect of the present invention, the wear state of wires 46 is directly determined using a sensed wear parameter associated with wires 46. The sensed parameter may be, e.g., in the form of a sound wave which is reflected from a wire 46, sensed pressure pulsations within accepts outlet 24, thermal expansion of wires 46 and/or electrical resistance of wires 46. Other signals which correllate to a change in the geometric shape of wires 46 (i.e., wear) may also be utilized.

Referring to FIGS. 2 and 3, a first embodiment of a sensor configuration which senses sound waves reflected from one or more wires 46 is shown and will be described in further detail. A sensor 20 is mounted within a selected retaining ring of retaining rings 48 and transmits a sound signal in the form of a sound wave against an end of a selected wire 46. More particularly, sensor 20, in the embodiment shown, is configured as a transceiver including both a sound transmitter as well as a receiver. A sound wave is projected against an end of a selected wire 46 and at least a portion of the sound wave is reflected to the receiver within sensor 20. Sensor 20 provides an output signal via conductor 56 indicative of the received sound wave which is reflected from the end of the selected wire 46.

FIG. 3 graphically illustrates the difference in the signal transmitted via conductor 56 for both a new wire 46 (top illustration) and a worn wire 46 needing replaced (bottom illustration). As is apparent, the amplitude of the signal transmitted over conductor 56 when wire 46 is new is substantially more than the amplitude of the signal which is transmitted over conductor 56 when wire 46 is worn to an undesirable amount. Appropriate circuitry (not shown) may of course be implemented to determine if the amplitude, frequency or other electrical characteristics of the signal transmitted over conductor 56 degrades past a threshold value.

Figure 4:
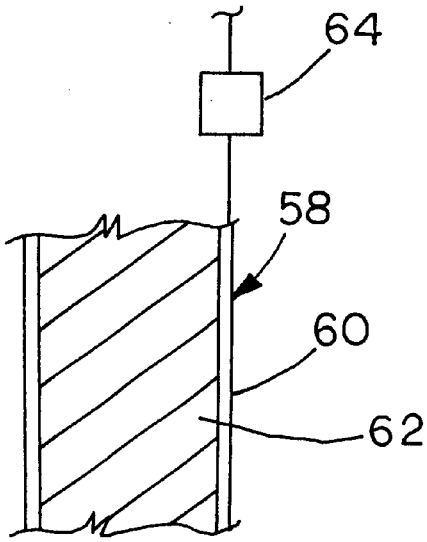
FIG. 4 is a partially sectioned, fragmentary view of another sensor arrangement of the present invention.

Referring to FIG. 4, another embodiment of a sensor arrangement of the present invention for sensing a wear state of a wire 58 is shown. Wire 58 is coated with an electrically conductive coating 60 which is dissimilar from the metal of core 62. Coating 60 is selected to be more electrically conductive than core 62. A sensor 64 is electrically coupled with coating 60 and an electrical charge is applied thereto. As wire 58 becomes worn, coating 60 is worn or removed from core 62, thereby increasing the resistance which is sensed by sensor 64. A wear state of wire 58 may thus be determined using sensor 64.

Figure 5:
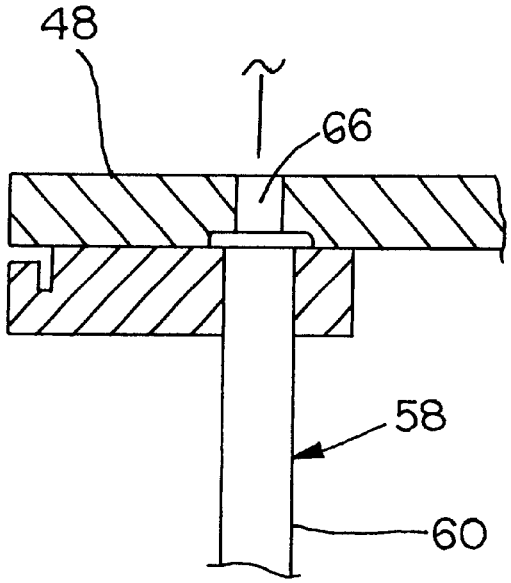
FIG. 5 is a partially sectioned, fragmentary view of yet another embodiment of a sensor arrangement of the present invention.

Referring now to FIG. 5, another embodiment of a sensor arrangement for sensing a wear state of wire 58 is illustrated. As with wire 58 shown in FIG. 4, wire 58 shown in FIG. 5 is likewise constructed with a coating 60 and core 62, thereby defining a bimetal structure which includes a metallic insert. Upon wear of coating 60, the thermal expansion characteristics of wire 58 change. Sensor 66 is configured to sense a load applied thereto by wire 58. The load applied to sensor 66 is related to the thermal expansion properties of wire 58, which in turn is related to the wear state of coating 60 on wire 58.

Sensor 20B is configured as a pressure sensor which is positioned within accepts outlet 24 associated with accepts chamber 52. As wires 46 become worn, the distance between adjacent wires increases which in turn affects the pressure pulsations occurring within accepts chamber 52. Pressure sensor 20B is configured to sense the pressure pulsations and provide an output signal indicative thereof. The output signals from pressure sensor 20B may be used to determine the wear state of wires 46. Of course, one and/or both of sensors 20 and 20B may be utilized to detect the wear state of wires 46.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A screening apparatus for screening acceptable and rejectable material from a pressurized fiber suspension, said screening apparatus comprising:

a housing;

a rotor;

a screen basket positioned generally concentrically around said rotor, said screen basket including at least one screen element, at least one said screen element including at least one bimetallic part; and at least one sensor positioned in association with said screen basket, said sensor configured for sensing a wear parameter relating to a wear state of said at least one screen element including sensing of at least one of an electrical characteristic and thermal expansion of said bimetallic part.

2. The screening apparatus of claim 1, wherein said screen basket defines an accept chamber, at least one said sensor comprising a pressure sensor positioned in association with said accept chamber.

3. The screening apparatus of claim 2, wherein said housing and said screen basket define said accept chamber.

4. The screening apparatus of claim 1, wherein said bimetallic part comprises a metallic coating on said at least one screen element.

5. The screening apparatus of claim 4, wherein said coating comprises an electrically conductive coating.

6. The screening apparatus of claim 1, wherein said bimetallic part comprises a metallic insert.

7. The screening apparatus of claim 1, wherein said at least one screen element comprises a plurality of generally axially extending wires positioned around a periphery of said screen basket.

8. The screening apparatus of claim 1, wherein said at least one screen element comprises a screen plate.

9. A screening apparatus for screening acceptable and rejectable material from a pressurized fiber suspension, said screening apparatus comprising:

a housing;

a rotor;

a screen basket positioned generally concentrically around said rotor, said screen basket including at least one screen element and at least one bimetal part associated with at least one said screet element; and at least one sensor positioned in association with said screen basket, said sensor configured for sensing a wear parameter relating to a wear state of said at least one screen element including sensing of at least one of pressure pulsations and thermal expansion within at least one said screen element, at least one said sensor being configured to sense thermal expansion of said bimetal part, said thermal expansion associated with said wear parameter.

10. A screening apparatus for screening acceptable and rejectable material from a pressurized fiber suspension, said screening apparatus comprising:

a housing;

a rotor;

a screen basket positioned generally concentrically around said rotor, said screen basket including at least one screen element and at least one bimetal part associated with at least one said screen element; and at least one sensor positioned in association with said screen basket, said sensor configured for sensing a wear parameter relating to a wear state of said at least one screen element including sensing of at least one of pressure pulsations of the pressurized fiber suspension adjacent to said screen basket and thermal expansion of at least one said screen element, at least one said sensor being configured to sense an electrical characteristic of said bimetal part, said electrical characteristic associated with said wear parameter.

11. The screening apparatus of claim 10, wherein said electrical characteristic comprises an electrical resistance of said bimetal part.

12. A screening apparatus for screening acceptable and rejectable material from a pressurized fiber suspension, said screening apparatus comprising:

a housing;

a rotor;

a screen basket positioned generally concentrically around said rotor, said screen basket including at least one screen element and at least one bimetal part associated with at least one said screen element, said bimetal part including a electrically conductive metallic coating on said at least one screen element; and at least one sensor positioned in association with said screen basket, said sensor configured for sensing a wear parameter relating to a wear state of said at least one screen element including sensing of at least one of pressure pulsations of the pressurized fiber suspension adjacent to said screen basket and thermal expansion of at least one said screen element, at least one said sensor being configured to sense an electrical resistance of said coating, said electrical resistance associated with said wear parameter.

13. In a screening apparatus, a method of screening acceptable and rejectable material from a pressurized fiber suspension, said method comprising the steps of:

providing a housing, a rotor within said housing, and a screen basket positioned generally concentrically around said rotor, said screen basket including at least one screen element;

positioning a sensor in association with said screen basket; and sensing a wear parameter with said sensor, said wear parameter relating to a wear state of said at least one screen element including sensing of at least one of pressure pulsations of the pressurized fiber suspension adjacent to said screen basket and thermal expansion of at least one said screen element.

14. The method of claim 13, wherein said sensing step comprises sensing a pressure of the fiber suspension within an accept chamber.

15. In a screening apparatus, a method of screening acceptable and rejectable material from a pressurized fiber suspension, said method comprising the steps of:

providing a housing, a rotor within said housing, and a screen basket positioned generally concentrically around said rotor, said screen basket including at least one screen element and at least one bimetal part associated with at least one said screen element;

positioning a sensors in association with said screen basket; and sensing a wear parameter with said sensor, said wear parameter relating to a wear state of said at least one screen element including sensing thermal expansion of said bimetal part, said thermal expansion associated with said wear parameter.

16. In a screening apparatus, a method of screening acceptable and rejectable material from a pressurized fiber suspension, said method comprising the steps of:

providing a housing, a rotor within said housing, and a screen basket positioned generally concentrically around said rotor, said screen basket including at least one screen element and at least one bimetal part associated with at least one said screen element;

positioning a sensor in association with said screen basket; and sensing a wear parameter with said sensor, said wear parameter relating to an electrical characteristic of said bimetal part.

17. The method of claim 16, wherein said electrical characteristic comprises an electrical resistance of said bimetal part.

18. The method of claim 17, wherein said bimetal part comprises a metallic coating.

* * * * *